US011134736B1

(12) United States Patent
Butler

(10) Patent No.: US 11,134,736 B1
(45) Date of Patent: Oct. 5, 2021

(54) PAPER HAT KIT

(71) Applicant: Lauren Butler, Bethlehem, PA (US)

(72) Inventor: Lauren Butler, Bethlehem, PA (US)

( * ) Notice: Subject to any disclaimer, the term of this patent is extended or adjusted under 35 U.S.C. 154(b) by 377 days.

(21) Appl. No.: 16/292,444

(22) Filed: Mar. 5, 2019

(51) Int. Cl.

| | |
|---|---|
| ***A42B 1/208*** | (2021.01) |
| ***A42B 1/004*** | (2021.01) |
| ***A42B 1/205*** | (2021.01) |
| ***A42B 1/041*** | (2021.01) |
| ***A42B 1/0184*** | (2021.01) |
| ***A42B 1/0192*** | (2021.01) |

(52) U.S. Cl.
CPC ..... *A42B 1/004* (2013.01); *A42B 1/0184* (2021.01); *A42B 1/0192* (2021.01); *A42B 1/041* (2013.01); *A42B 1/205* (2013.01); *A42B 1/208* (2013.01)

(58) Field of Classification Search
CPC ..... A42B 1/004; A42B 1/041; A42B 1/205; A42B 1/208; A42B 1/019; A42B 1/02; A42B 1/04; A42B 1/00; A42B 1/201; A42B 1/0184; A42C 1/00
USPC ..... 2/200.3, 200.1, 1, 244, 171.01, 171.1; D2/873, 886, 895
See application file for complete search history.

(56) References Cited

U.S. PATENT DOCUMENTS

| | | | | | |
|---|---|---|---|---|---|
| 131,371 | A * | 9/1872 | Pratt | A42B 1/205 | 2/171.1 |
| 930,304 | A * | 8/1909 | Mate | A45F 5/08 | 24/5 |
| 945,268 | A * | 1/1910 | Dodd | A42B 1/02 | 2/175.1 |
| 1,250,968 | A * | 12/1917 | Claussen | A42B 1/248 | 2/195.1 |
| 1,418,198 | A * | 5/1922 | Neppell | A42B 1/201 | 2/209.7 |
| D111,674 | S * | 10/1938 | Wittcoff | D2/886 | |
| 2,594,906 | A | 4/1952 | Gardner | | |
| 2,682,668 | A | 7/1954 | Hoeflich | | |
| 3,082,429 | A | 3/1963 | Villers | | |
| 3,358,293 | A * | 12/1967 | Wanamaker | A42B 1/208 | 2/200.3 |
| 5,091,994 | A * | 3/1992 | Delane | G09F 21/02 | 2/209.13 |
| 5,553,327 | A * | 9/1996 | Koecher | A42B 1/02 | 2/175.1 |
| D390,689 | S | 2/1998 | Ochiai | | |
| 6,295,649 | B1 * | 10/2001 | Kang | A42B 1/004 | 2/12 |
| 6,728,972 | B1 * | 5/2004 | Whitley | A42B 1/02 | 2/175.1 |
| D518,278 | S * | 4/2006 | Martin | D2/886 | |
| D522,720 | S * | 6/2006 | Leblanc | D2/873 | |
| 8,635,713 | B2 | 1/2014 | Smith | | |
| D761,523 | S | 7/2016 | Caird | | |
| 2004/0149814 | A1 * | 8/2004 | Montana, II | A42B 1/02 | 229/103 |
| 2004/0256282 | A1 | 12/2004 | Glenn | | |

(Continued)

FOREIGN PATENT DOCUMENTS

| | | | |
|---|---|---|---|
| CA | 506721 | A * | 10/1954 |

*Primary Examiner* — Jameson D Collier

(57) ABSTRACT

The paper hat kit includes a first composite panel, a second composite panel, and a plurality of decorative structures. The first composite panel and the second composite panel are fastened together to form a hat. Each of the plurality of decorative structures attaches to either the first composite panel and the second composite panel.

18 Claims, 6 Drawing Sheets

(56) References Cited

U.S. PATENT DOCUMENTS

| | | | | |
|---|---|---|---|---|
| 2006/0143798 | A1 | 7/2006 | Chen | |
| 2013/0205475 | A1* | 8/2013 | Jones | A42B 1/201 2/209.13 |
| 2017/0347734 | A1* | 12/2017 | Sussmann | A42B 1/208 |

* cited by examiner

PAPER HAT KIT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of headwear including hats, more specifically, a hat made of separable parts. (A42B1/205)

SUMMARY OF INVENTION

The paper hat kit is a kit. The paper hat kit comprises a first composite panel, a second composite panel, and a plurality of decorative structures. The first composite panel and the second composite panel are fastened together to form a hat. Each of the plurality of decorative structures attaches to a panel selected from the group consisting of the first composite panel and the second composite panel.

These together with additional objects, features and advantages of the paper hat kit will be readily apparent to those of ordinary skill in the art upon reading the following detailed description of the presently preferred, but nonetheless illustrative, embodiments when taken in conjunction with the accompanying drawings.

In this respect, before explaining the current embodiments of the paper hat kit in detail, it is to be understood that the paper hat kit is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the paper hat kit.

It is therefore important that the claims be regarded as including such equivalent construction insofar as they do not depart from the spirit and scope of the paper hat kit. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
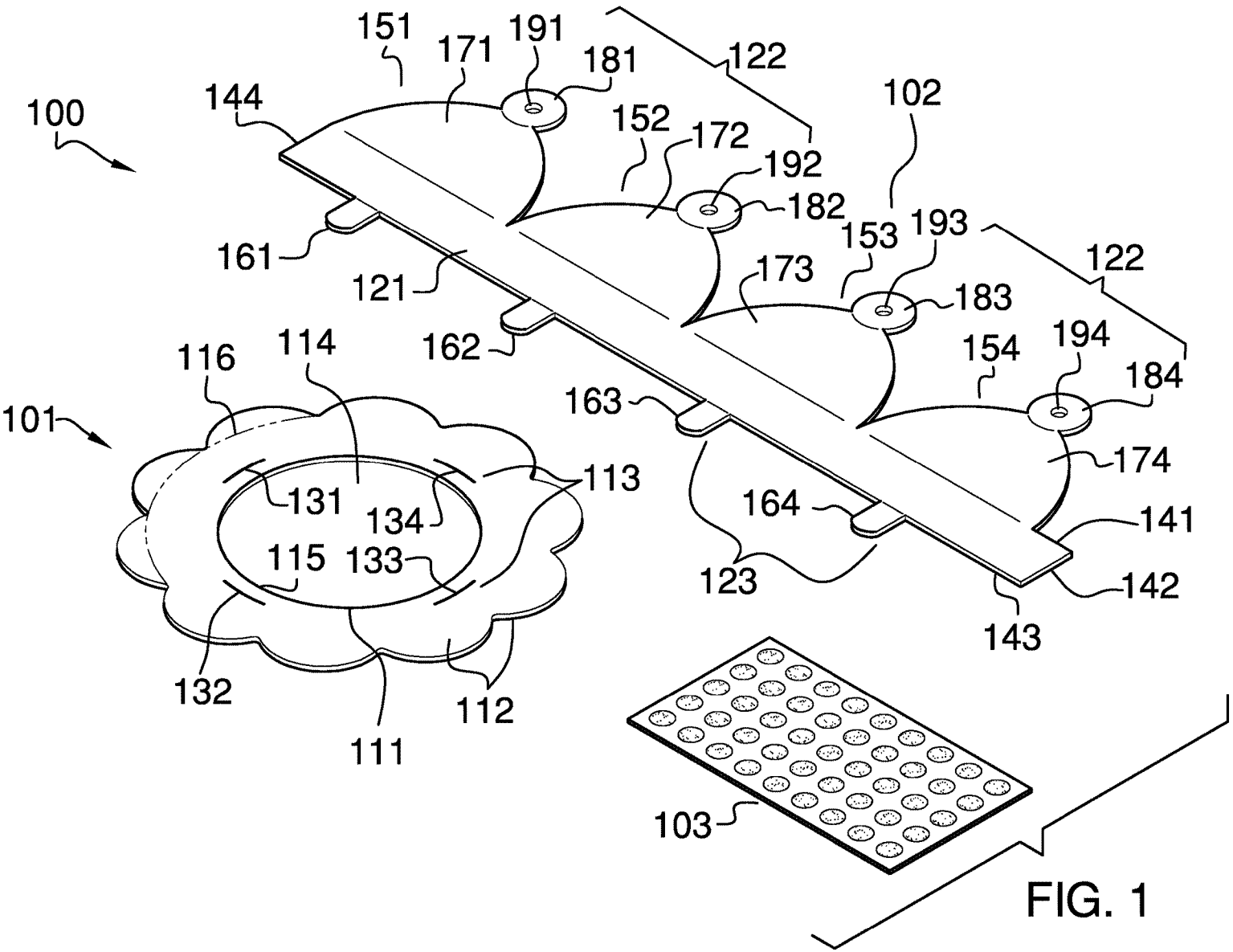
FIG. 1 is a perspective view of an embodiment of the disclosure.
Figure 2:
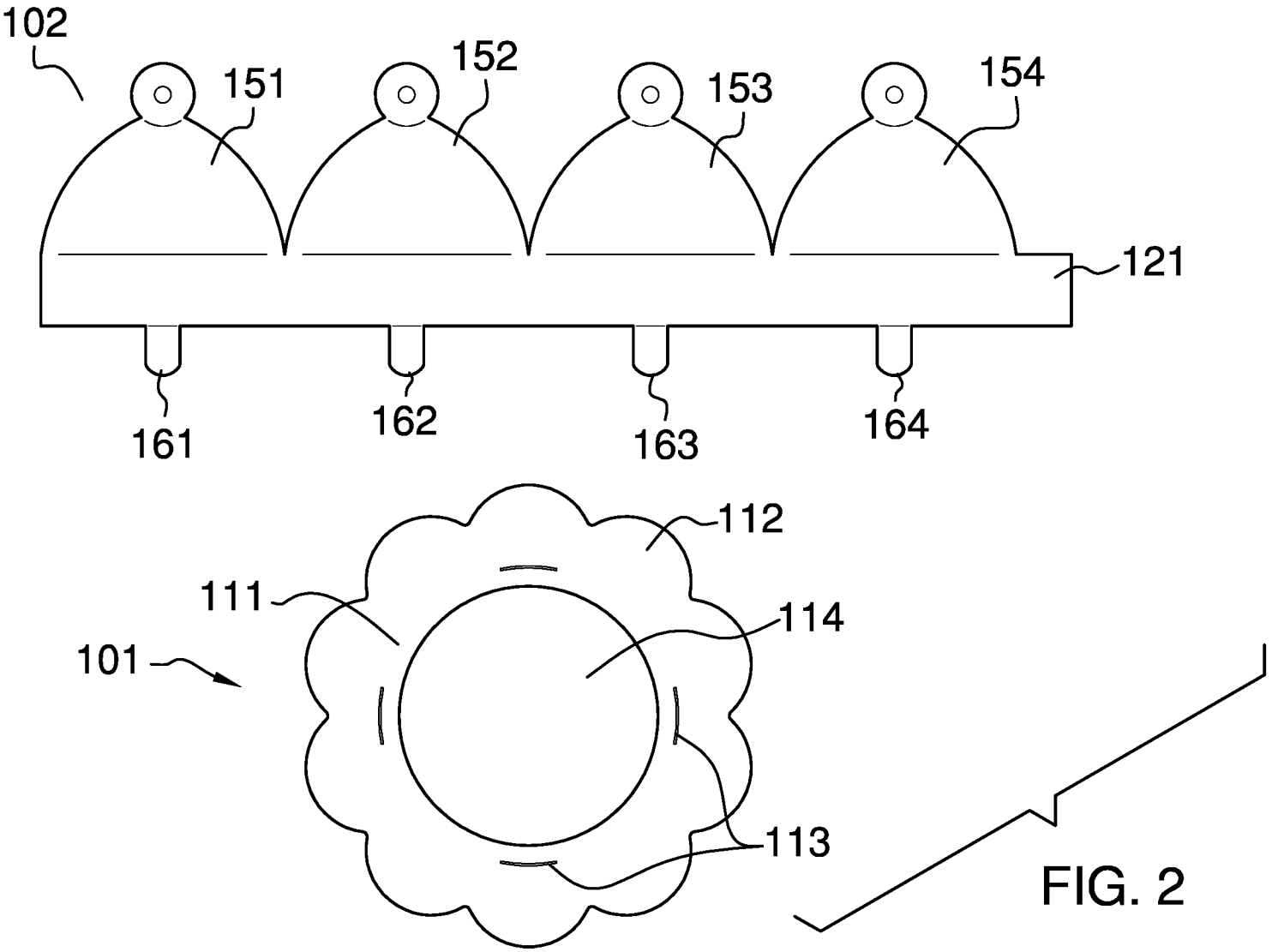
FIG. 2 is a front view of an embodiment of the disclosure.
Figure 3:
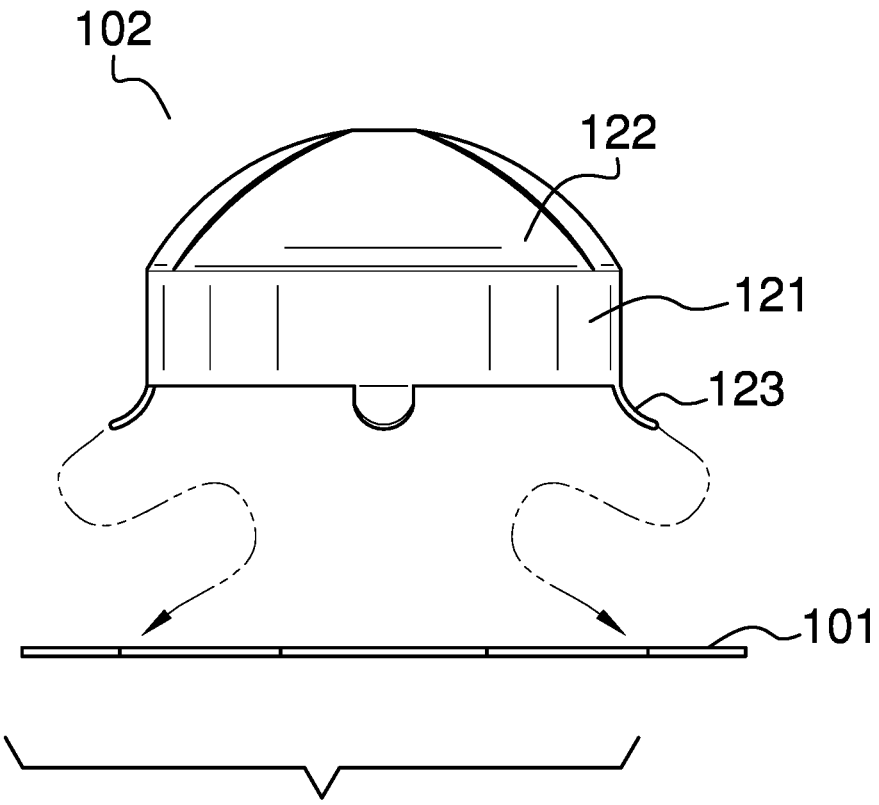
FIG. 3 is an exploded view of an embodiment of the disclosure.
Figure 4:
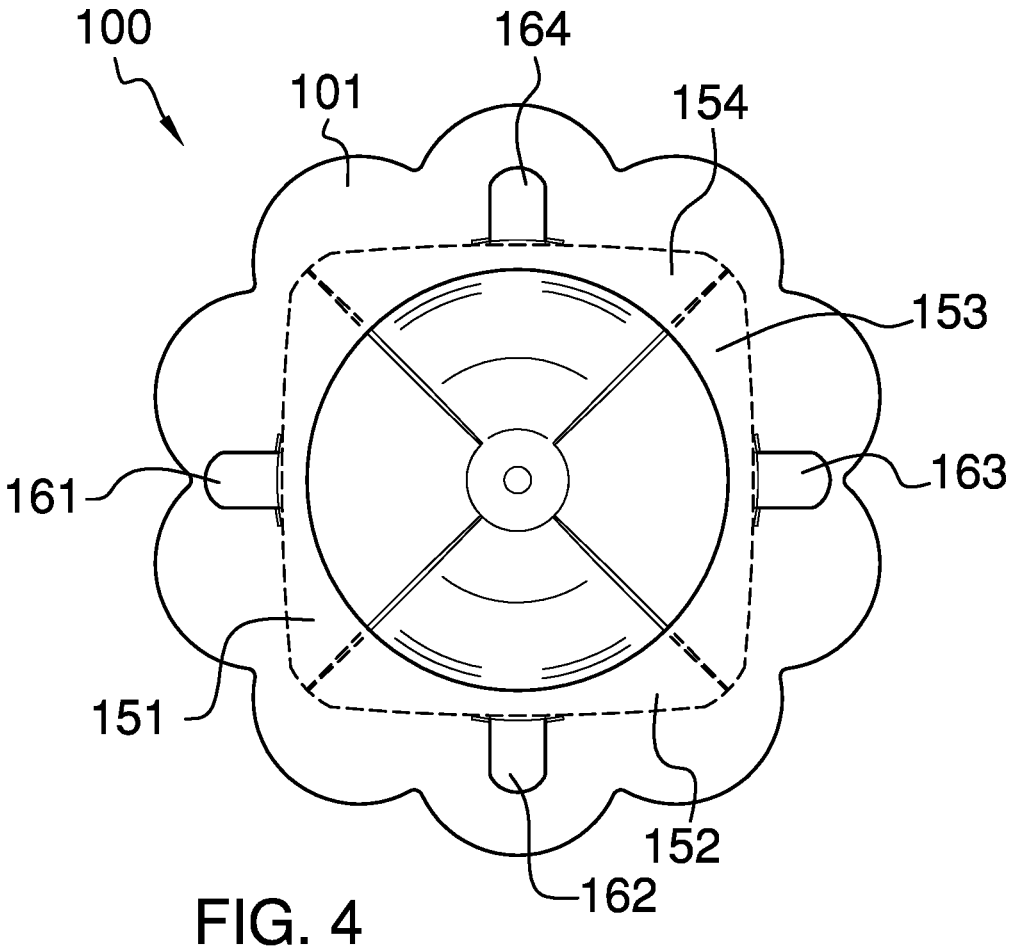
FIG. 4 is a bottom view of an embodiment of the disclosure.
Figure 5:
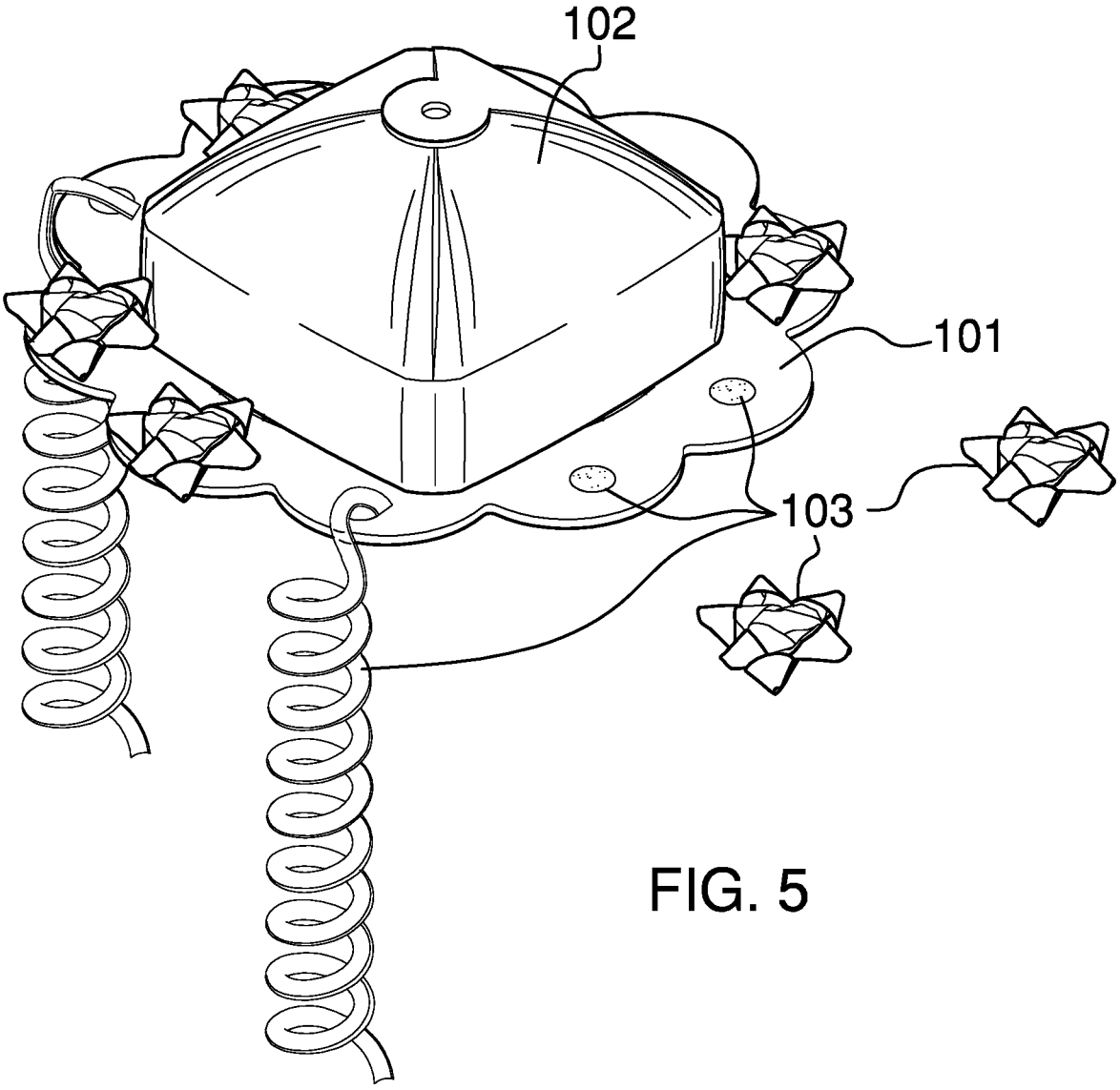
FIG. 5 is an in-use view of an embodiment of the disclosure.
Figure 6:
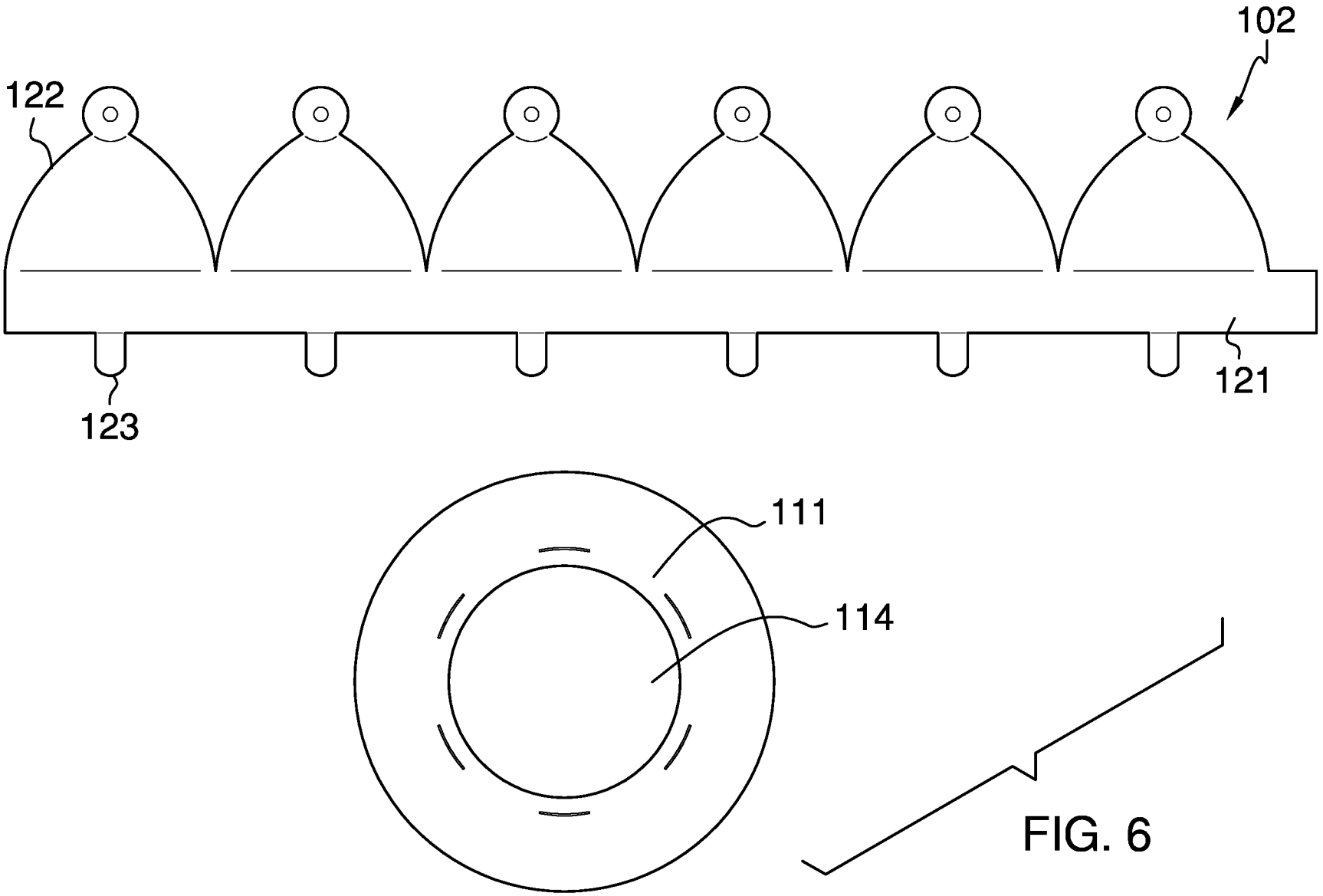
FIG. 6 is a perspective view of an alternate embodiment of the disclosure.

Detailed reference will now be made to one or more potential embodiments of the disclosure, which are illustrated in FIGS. 1 through 6.

The paper hat kit 100 (hereinafter invention) is a kit. The invention 100 comprises a first composite panel 101, a second composite panel 102, and a plurality of decorative structures 103. The first composite panel 101 and the second composite panel 102 are fastened together to form a hat. Each of the plurality of decorative structures 103 attaches to a panel selected from the group consisting of the first composite panel 101 and the second composite panel 102.

Each of the plurality of decorative structures 103 is a decorative item that attaches to a panel selected from the first composite panel 101 and the second composite panel 102. Each of the plurality of decorative structures 103 is a celebratory structure that attaches to the hat assembled from the first composite panel 101 and the second composite panel 102.

The first composite panel 101 is a semi-rigid structure with an elastic nature. The first composite panel 101 is formed with a two-dimensional composite structure. The first composite panel 101 has an irregular disk structure. In the first potential embodiment of the disclosure, the first composite panel 101 is formed as a single structure from a paper sheeting that is cut to create the irregular disk structure. The first composite panel 101 comprises a circular ring 111, a plurality of parabolas 112, and a plurality of slots 113. The circular ring 111 is further defined with a circular aperture 114, an inner perimeter 115, and an outer perimeter 116.

The circular ring 111 is a sub-component of the composite structure that forms the first composite panel 101. Each of the plurality of parabolas 112 is a sub-component of the composite structure that forms the first composite panel 101.

The circular ring 111 and each of the plurality of parabolas 112 are combined as an overlay to form a single composite structure that has a disk shape. The circular ring 111 is a ring structure. The circular ring 111 is defined with a circular outer perimeter 116. The second composite panel 102 attaches to the circular ring 111 of the first composite panel 101.

Each of the plurality of parabolas 112 is a parabolic shape that is formed in the disk structure of the first composite panel 101. Each of the plurality of parabolas 112 is overlaid along the outer perimeter 116 of the circular ring 111. Each of the plurality of parabolas 112 are distributed evenly along the outer perimeter 116 of the circular ring 111. Each of the plurality of parabolas 112 are aligned such that the center axis of the parabolic structure aligns with the center of the circular structure of the circular ring 111.

Each of the plurality of slots 113 is a slot that is cut through the circular ring 111 of the first composite panel 101. The plurality of slots 113 is cut through the first face of the disk structure of the circular ring 111 to the second face of the disk structure of the circular ring 111. Each of the plurality of slots 113 receives a tab selected from a plurality of tabs 123 incorporated into the composite structure of the second composite panel 102. The plurality of slots 113 comprises a first slot 131, a second slot 132, a third slot 133, and a fourth slot 134.

The first slot 131 is a slot that is cut through the faces of the disk structure of the circular ring 111. The first slot 131 has an equidistant position between the fourth slot 134 and the second slot 132. The second slot 132 is a slot that is cut through the faces of the disk structure of the circular ring 111. The second slot 132 has an equidistant position between the first slot 131 and the third slot 133. The third slot 133 is a slot that is cut through the faces of the disk structure of the circular ring 111. The third slot 133 has an equidistant position between the second slot 132 and the fourth slot 134. The fourth slot 134 is a slot that is cut through the faces of the disk structure of the circular ring 111. The fourth slot 134 has an equidistant position between the third slot 133 and the first slot 131.

The circular aperture 114 is a negative space that is formed through the faces of the disk structure of the circular ring 111. The circular aperture 114 has a circular shape. The circular aperture 114 is coaxially positioned at the center of the circular ring 111. The circular aperture 114 forms an inner perimeter 115 of the circular ring 111.

The inner perimeter 115 is defined in greater detail elsewhere in this disclosure. The outer perimeter 116 is defined in greater detail elsewhere in this disclosure.

The circular ring 111 and the plurality of parabolas 112 combine to form the brim of the hat structure of the combination of the first composite panel 101 and the second composite panel 102. The circular aperture 114 is sized to receive a head while the hat is worn.

The second composite panel 102 is a semi-rigid structure with an elastic nature. The second composite panel 102 is formed with a two-dimensional composite structure. The second composite panel 102 has an irregular disk structure. In the first potential embodiment of the disclosure, the second composite panel 102 is formed as a single structure from a paper sheeting that is cut to create the irregular disk structure. The second composite panel 102 attaches to the first composite panel 101 to form a hat. The second composite panel 102 comprises a strip 121, a plurality of composite sub-panels 122, and a plurality of tabs 123.

The strip 121 is a sub-component of the composite structure that forms the second composite panel 102. The plurality of composite sub-panels 122 is a sub-component of the composite structure that forms the second composite panel 102. The plurality of tabs 123 is a sub-component of the composite structure that forms the second composite panel 102. The plurality of composite sub-panels 122 and the plurality of tabs 123 both attach to the strip 121 to form an overlay that forms a single composite structure that has a disk shape.

The strip 121 is a rectangular disk structure. The strip 121 is a semi-rigid structure with an elastic nature. The strip 121 has a disk structure. The strip 121 is formed from a paper sheeting that is cut to create the rectangular disk structure. Two ends of the strip 121 are joined together when the second composite panel 102 attaches to the first composite panel 101 such that the strip 121 forms a loop structure that follows along the inner perimeter 115 formed by the circular aperture 114 of the circular ring 111. The strip 121 is further defined with a first edge 141, a second edge 142, a third edge 143, and a fourth edge 144.

The first edge 141 is the edge of the strip 121 with the greatest span of length. The second edge 142 is the edge of the strip 121 with the least span of length. The second edge 142 runs in a direction perpendicular to the first edge 141. The second edge 142 runs in a direction perpendicular to the third edge 143. The third edge 143 is the edge of the strip 121 that is distal from the first edge 141. The third edge 143 is parallel to the first edge 141. The fourth edge 144 is the edge of the strip 121 that is distal from the second edge 142. The fourth edge 144 is parallel to the second edge 142.

Each of the plurality of composite sub-panels 122 is a semi-rigid structure with an elastic nature. The plurality of composite sub-panels 122 is formed with a two-dimensional composite structure. The plurality of composite sub-panels 122 has an irregular disk structure. The plurality of composite sub-panels 122 is formed from a paper sheeting that is cut to create the irregular disk structure. Each of the plurality of composite sub-panels 122 projects away from the first edge 141 of the strip 121. The second composite panel 102 attaches to the first composite panel 101 each of the plurality of composite sub-panels 122 are folded towards the center of the circular ring 111 such that the plurality of composite sub-panels 122 forms the cover (crown) of the hat structure. The plurality of composite sub-panels 122 comprises a first composite sub-panel 151, a second composite sub-panel 152, a third composite sub-panel 153, and a fourth composite sub-panel 154.

Each of the plurality of tabs 123 is a semi-rigid structure with an elastic nature. The plurality of tabs 123 is formed with a two-dimensional composite structure. The plurality of tabs 123 has a disk structure. The plurality of tabs 123 is formed from a paper sheeting that is cut to create the disk structure. Each of the plurality of tabs 123 projects away from the third edge 143 of the strip 121. There is a one to one correspondence between the plurality of tabs 123 and the plurality of slots 113. The second composite panel 102 attaches to the first composite panel 101 by inserting each tab selected from the plurality of tabs 123 into its associated slot selected from the plurality of slots 113. The plurality of tabs 123 comprises a first tab 161, a second tab 162, a third tab 163, and a fourth tab 164.

The first slot 131 is sized to receive the first tab 161 of the plurality of tabs 123. The second slot 132 is sized to receive the second tab 162 of the plurality of tabs 123. The third slot 133 is sized to receive the third tab 163 of the plurality of tabs 123. The fourth slot 134 is sized to receive the fourth tab 164 of the plurality of tabs 123.

The first tab 161 is a rounded rectangular structure. The first tab 161 is further defined with a major axis and a minor axis. The first tab 161 projects away from the third edge 143 of the strip 121 such that the major axis of the first tab 161 is perpendicular to the major axis of the strip 121.

The second tab 162 is a rounded rectangular structure. The second tab 162 is further defined with a major axis and a minor axis. The second tab 162 projects away from the third edge 143 of the strip 121 such that the major axis of the second tab 162 is perpendicular to the major axis of the strip 121.

The third tab 163 is a rounded rectangular structure. The third tab 163 is further defined with a major axis and a minor axis. The third tab 163 projects away from the third edge 143 of the strip 121 such that the major axis of the third tab 163 is perpendicular to the major axis of the strip 121.

The fourth tab 164 is a rounded rectangular structure. The fourth tab 164 is further defined with a major axis and a minor axis. The fourth tab 164 projects away from the third edge 143 of the strip 121 such that the major axis of the fourth tab 164 is perpendicular to the major axis of the strip 121.

The span of the distance between the span of the distance between the major axis of the second tab 162 and the major axis of the first tab 161 equals the span of the distance between the major axis of the second tab 162 and the major axis of the third tab 163.

The span of the distance between the span of the distance between the major axis of the third tab 163 and the major axis of the second tab 162 equals the span of the distance between the major axis of the third tab 163 and the major axis of the fourth tab 164.

The span of the distance between the span of the distance between the major axis of the first tab 161 and the fourth edge 144 of the strip 121 equals the span of the distance between the major axis of the fourth tab 164 and the second edge 142 of the strip 121.

The first composite sub-panel 151 is a sub-component of the composite structure that forms the second composite panel 102. The first composite sub-panel 151 is selected from the plurality of composite sub-panels 122. The first composite sub-panel 151 is further defined with a center axis. The first composite sub-panel 151 comprises a first parabola 171 and a first ring 181.

The second composite sub-panel 152 is a sub-component of the composite structure that forms the second composite panel 102. The second composite sub-panel 152 is selected from the plurality of composite sub-panels 122. The second composite sub-panel 152 is further defined with a center axis. The span of the distance between the span of the distance between the center axis of the second composite sub-panel 152 and the center axis of the first composite sub-panel 151 equals the span of the distance between the center axis of the second composite sub-panel 152 and the center axis of the third composite sub-panel 153. The second composite sub-panel 152 comprises a second parabola 172 and a second ring 182.

The third composite sub-panel 153 is a sub-component of the composite structure that forms the second composite panel 102. The third composite sub-panel 153 is selected from the plurality of composite sub-panels 122. The third composite sub-panel 153 is further defined with a center axis. The span of the distance between the span of the distance between the center axis of the third composite sub-panel 153 and the center axis of the second composite sub-panel 152 equals the span of the distance between the center axis of the third composite sub-panel 153 and the center axis of the fourth composite sub-panel 154. The third composite sub-panel 153 comprises a third parabola 173 and a third ring 183.

The fourth composite sub-panel 154 is a sub-component of the composite structure that forms the second composite panel 102. The fourth composite sub-panel 154 is selected from the plurality of composite sub-panels 122. The fourth composite sub-panel 154 is further defined with a center axis. The span of the distance between the span of the distance between the center axis of the first composite sub-panel 151 and the fourth edge 144 of the strip 121 equals the span of the distance between the center axis of the fourth composite sub-panel 154 and the second edge 142 of the strip 121. The fourth composite sub-panel 154 comprises a fourth parabola 174 and a fourth ring 184.

The first parabola 171 is a sub-component of the composite sub-panel that forms the first composite sub-panel 151. The first parabola 171 is a disk structure that has the shape of a parabola. The first parabola 171 is further defined with a center axis which forms the center axis of the first composite sub-panel 151. The first parabola 171 projects away from the first edge 141 of the strip 121 such that the center axis of the first parabola 171 is perpendicular to the major axis of the strip 121.

The first ring 181 is a sub-component of the composite sub-panel that forms the first composite sub-panel 151. The first ring 181 is a sub-component of the composite sub-panel that forms the first composite sub-panel 151. The first ring 181 is a disk structure that has the shape of a ring. The first ring 181 is further defined with a center. The first ring 181 attaches to the first parabola 171 such that the apex of the first ring 181 is enclosed within the perimeter of the first ring 181. The first ring 181 attaches to the first parabola 171 such that the center of the first ring 181 aligns with the center axis of the first parabola 171.

The first ring 181 is further defined with a first ring aperture 191. The first ring aperture 191 is a circular negative space that is formed through the disk structure of the first ring 181. The first ring aperture 191 is coaxially positioned within the first ring 181.

The second parabola 172 is a sub-component of the composite sub-panel that forms the second composite sub-panel 152. The second parabola 172 is a disk structure that has the shape of a parabola. The second parabola 172 is further defined with a center axis which forms the center axis of the second composite sub-panel 152. The second parabola 172 projects away from the first edge 141 of the strip 121 such that the center axis of the second parabola 172 is perpendicular to the major axis of the strip 121.

The second ring 182 is a sub-component of the composite sub-panel that forms the second composite sub-panel 152. The second ring 182 is a sub-component of the composite sub-panel that forms the second composite sub-panel 152. The second ring 182 is a disk structure that has the shape of a ring. The second ring 182 is further defined with a center. The second ring 182 attaches to the second parabola 172 such that the apex of the second ring 182 is enclosed within the perimeter of the second ring 182. The second ring 182 attaches to the second parabola 172 such that the center of the second ring 182 aligns with the center axis of the second parabola 172.

The second ring 182 is further defined with a second ring aperture 192. The second ring aperture 192 is a circular negative space that is formed through the disk structure of the second ring 182. The second ring aperture 192 is coaxially positioned within the second ring 182.

The third parabola 173 is a sub-component of the composite sub-panel that forms the third composite sub-panel 153. The third parabola 173 is a disk structure that has the shape of a parabola. The third parabola 173 is further defined with a center axis which forms the center axis of the third composite sub-panel 153. The third parabola 173 projects away from the first edge 141 of the strip 121 such that the center axis of the third parabola 173 is perpendicular to the major axis of the strip 121.

The third ring 183 is a sub-component of the composite sub-panel that forms the third composite sub-panel 153. The third ring 183 is a sub-component of the composite sub-panel that forms the third composite sub-panel 153. The third ring 183 is a disk structure that has the shape of a ring. The third ring 183 is further defined with a center. The third ring 183 attaches to the third parabola 173 such that the apex of the third ring 183 is enclosed within the perimeter of the third ring 183. The third ring 183 attaches to the third parabola 173 such that the center of the third ring 183 aligns with the center axis of the third parabola 173.

The third ring 183 is further defined with a third ring aperture 193. The third ring aperture 193 is a circular negative space that is formed through the disk structure of the third ring 183. The third ring aperture 193 is coaxially positioned within the third ring 183.

The fourth parabola 174 is a sub-component of the composite sub-panel that forms the fourth composite sub-panel 154. The fourth parabola 174 is a disk structure that has the shape of a parabola. The fourth parabola 174 is further defined with a center axis which forms the center axis of the fourth composite sub-panel 154. The fourth parabola 174 projects away from the first edge 141 of the strip 121 such that the center axis of the fourth parabola 174 is perpendicular to the major axis of the strip 121.

The fourth ring 184 is a sub-component of the composite sub-panel that forms the fourth composite sub-panel 154. The fourth ring 184 is a sub-component of the composite sub-panel that forms the fourth composite sub-panel 154. The fourth ring 184 is a disk structure that has the shape of a ring. The fourth ring 184 is further defined with a center. The fourth ring 184 attaches to the fourth parabola 174 such that the apex of the fourth ring 184 is enclosed within the perimeter of the fourth ring 184. The fourth ring 184 attaches to the fourth parabola 174 such that the center of the fourth ring 184 aligns with the center axis of the fourth parabola 174.

The fourth ring 184 is further defined with a fourth ring aperture 194. The fourth ring aperture 194 is a circular negative space that is formed through the disk structure of the fourth ring 184. The fourth ring aperture 194 is coaxially positioned within the fourth ring 184.

The use of the first ring aperture 191, the second ring aperture 192, the third ring aperture 193, and the fourth ring aperture 194 allow the plurality of composite sub-panels 122 to be held together using a clip or a shaft when the invention 100 is worn.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bowl: As used in this disclosure, a bowl is a rounded hollow containment structure.

Cardboard: As used in this disclosure, cardboard is a structural sheeting made from a fibrous material similar to that used in the manufacture of paper. Cardboard is an inexpensive material commonly used to make containers.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Coaxial: As used in this disclosure, coaxial is an term that refers to a first object that is inserted or contained within a second object such: 1) that the first object and the second object share the same center point if the or first object and the second object are treated as a two-dimensional objects; or, 2) that the first object and the second object share the same center axis if the or first object and the second object are treated as a prism. Coaxial objects are often referred to as concentric.

Composite: As used in this disclosure, composite refers to a two-dimensional or three-dimensional structure that that is formed from two or more distinctly identifiable sub-structures.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One Gibbous: As used in this disclosure, gibbous is an adjective that refers to an enclosed shape wherein: a) a portion of the perimeter of the enclosed shape is formed by the arc of a first quadric curve; and, b) the balance of the perimeter is formed from a second quadric curve a concavity similar to the perimeter formed by the circle.

Inner Perimeter and Outer Perimeter: As used in this disclosure, the inner perimeter and the outer perimeter refer to two geometrically similar structures of a curved object. The inner perimeter refers to the geometrically similar structure with the shorter span. The outer perimeter refers to the geometrically similar structure with the greater span.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to the longest edge of a rectangular structure.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Overlay: As used in this disclosure, an overlay refers to the placement of a second planar structure over a first planar structure such the combined planar structure forms a planar shape that is created by the combined perimeters of the first planar structure and the second planar structure.

Paper: As used in this disclosure, paper refers to a sheeting material commonly used as: a) a substrate on which people write; b) a substrate on which images are displayed; and, c) wrapping items. Paper is typically made from plant fibers such as cellulose. Paper intended for specific purposes may be made from other materials.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Quadric Curve: As used in this disclosure, a quadric curve is a line that varies in the two Cartesian coordinates in an algebraically defined manner. Euclidian lines as well as the surfaces of ellipsoids, circles, parabolas, and hyperbolas, are examples of quadric curves. The Euclidian line is technically considered a degenerate form of a quadric curve but, unless specifically stated otherwise within this disclosure, is explicitly included in this definition. Quadric curves are described by the general algebraic form: $Ax^2+By^2+Cxy+Dx+Ey+F=0$.

Radial: As used in this disclosure, the term radial refers to a direction that: 1) is perpendicular to an identified central axis; or, 2) projects away from a center point.

Ring: As used in this disclosure, a ring is a term that is used to describe a disk-like structure through which an aperture is formed. Rings are often considered loops.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Rounded: A used in this disclosure, the term rounded refers to the replacement of an apex, vertex, or edge or brink of a structure with a (generally smooth) curvature wherein the concave portion of the curvature faces the interior or center of the structure.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Sheeting: As used in this disclosure, a sheeting is a material, such as a paper, textile, a plastic, or a metal foil, in the form of a thin flexible layer or layers.

Slot: As used in this disclosure, a slot is a long narrow cavity or aperture that is formed in or through an object.

Tab: As used in this disclosure, a tab is a first object that is attached to a second object for the purpose of: facilitating the manipulation of the second object; or, 2) identification of the second object.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A kit for the assembly of headwear, the kit comprising:
- a first composite panel, a second composite panel, and a plurality of decorative structures;
- wherein the first composite panel and the second composite panel are configured to be fastened together to form a hat;
- wherein each of the plurality of decorative structures is configured to attach to a panel selected from the group consisting of: the first composite panel and the second composite panel;
- wherein the second composite panel comprises a strip, a plurality of composite sub-panels, and a plurality of tabs;
- wherein the strip is a rectangular disk structure;
- wherein the strip is a semi-rigid structure with an elastic nature;
- wherein the strip is formed from a paper sheeting that has been cut to create the rectangular disk structure;
- wherein two ends of the strip are joined together when the second composite panel attaches to the first composite panel such that the strip forms a loop structure that follows along the inner perimeter formed by the circular aperture of the circular ring;
- wherein the strip is further defined with a first edge, a second edge, a third edge, and a fourth edge;
- wherein the first edge is an edge of the strip with a greatest span of length;
- wherein the second edge is an edge of the strip with a least span of length;
- wherein the second edge runs in a direction perpendicular to the first edge;
- wherein the second edge runs in a direction perpendicular to the third edge;
- wherein the third edge is the edge of the strip that is distal from the first edge;
- wherein the third edge is parallel to the first edge;
- wherein the fourth edge is the edge of the strip that is distal from the second edge; and
- wherein the fourth edge is parallel to the second edge.

2. The kit for the assembly of headwear according to claim 1,
- wherein the first composite panel is a semi-rigid structure with an elastic nature;
- wherein the first composite panel is formed with a two-dimensional composite structure;
- wherein the first composite panel has an irregular disk structure;
- wherein the first composite panel is formed as a single structure from a paper sheeting that has been cut to create the irregular disk structure.

3. The kit for the assembly of headwear according to claim 2,
- wherein the second composite panel is a semi-rigid structure with an elastic nature;
- wherein the second composite panel is formed with a two-dimensional composite structure;
- wherein the second composite panel has an irregular disk structure;
- wherein the second composite panel is formed as a single structure from a paper sheeting that has been cut to create the irregular disk structure.

4. The kit for the assembly of headwear according to claim 3,
- wherein the first composite panel comprises a circular ring, a plurality of parabolas, and a plurality of slots;
- wherein the circular ring is a sub-component of the composite structure that forms the first composite panel;
- wherein each of the plurality of parabolas is a sub-component of the composite structure that forms the first composite panel;
- wherein the circular ring is further defined with a circular aperture, an inner perimeter, and an outer perimeter;
- wherein the circular ring and each of the plurality of parabolas, in combination, define an overlay that defines the first composite panel's composite structure that has the disk shape.

5. The kit for the assembly of headwear according to claim 4,
- wherein the second composite panel is configured to attach to the circular ring of the first composite panel.

6. The kit for the assembly of headwear according to claim 5,
- wherein each of the plurality of parabolas is formed in the disk structure of the first composite panel;
- wherein each of the plurality of parabolas is overlaid along the outer perimeter of the circular ring;
- wherein each of the plurality of parabolas are distributed evenly along the outer perimeter of the circular ring;
- wherein each of the plurality of parabolas are aligned such that a center axis of the parabolic structure of each of the plurality of parabolas aligns with a center of the circular structure of the circular ring.

7. The kit for the assembly of headwear according to claim 6,
- wherein each of the plurality of slots is a slot that has been cut through the circular ring of the first composite panel;
- wherein the plurality of slots is cut through a first face of the disk structure of the circular ring to a second face of the disk structure of the circular ring.

8. The kit for the assembly of headwear according to claim 7,
- wherein the plurality of slots comprises a first slot, a second slot, a third slot, and a fourth slot;
- wherein the first slot has an equidistant position between the fourth slot and the second slot;
- wherein the second slot has an equidistant position between the first slot and the third slot;
- wherein the third slot has an equidistant position between the second slot and the fourth slot;
- wherein the fourth slot has an equidistant position between the third slot and the first slot.

9. The kit for the assembly of headwear according to claim 8,
- wherein the circular aperture is a negative space that is formed through the first face and second faces of the disk structure of the circular ring;
- wherein the circular aperture is coaxially positioned at the center of the circular ring;

wherein the circular aperture forms the inner perimeter of the circular ring.

10. The kit for the assembly of headwear according to claim 9, wherein the strip is a sub-component of the composite structure that forms the second composite panel;

wherein the plurality of composite sub-panels is a sub-component of the composite structure that forms the second composite panel;

wherein the plurality of tabs is a sub-component of the composite structure that forms the second composite panel;

wherein the plurality of composite sub-panels, the plurality of tabs and the strip, in combination, define an overlay that defines the second composite panel's composite structure that has the disk shape.

11. The kit for the assembly of headwear according to claim 10, wherein each of the plurality of composite sub-panels is a semi-rigid structure with an elastic nature;

wherein the plurality of composite sub-panels has an irregular disk structure;

wherein the plurality of composite sub-panels is formed from a paper sheeting that has been cut to create the irregular disk structure;

wherein each of the plurality of composite sub-panels projects away from the first edge of the strip;

wherein the second composite panel is configured to attach to the first composite panel;

wherein each of the plurality of composite sub-panels are folded towards the center of the circular ring such that the plurality of composite sub-panels forms a cover or crown of the hat structure.

12. The kit for the assembly of headwear according to claim 11, wherein each of the plurality of tabs is a semi-rigid structure with an elastic nature;

wherein the plurality of tabs has a disk structure;

wherein the plurality of tabs is formed from a paper sheeting that has been cut to create the disk structure;

wherein each of the plurality of tabs projects away from the third edge of the strip;

wherein there is a one to one correspondence between the plurality of tabs and the plurality of slots;

wherein the second composite panel is configured to attach to the first composite panel by inserting each tab selected from the plurality of tabs into an associated slot selected from the plurality of slots;

wherein each of the plurality of slots is configured to receive a tab selected from a plurality of tabs incorporated into the composite structure of the second composite panel.

13. The kit for the assembly of headwear according to claim 12, wherein the plurality of composite sub-panels comprises a first composite sub-panel, a second composite sub-panel, a third composite sub-panel, and a fourth composite sub-panel;

wherein the first composite sub-panel is selected from the plurality of composite sub-panels;

wherein the first composite sub-panel is further defined with a center axis;

wherein the second composite sub-panel is a sub-component of the composite structure that forms the second composite panel;

wherein the second composite sub-panel is selected from the plurality of composite sub-panels;

wherein the second composite sub-panel is further defined with a center axis;

wherein the third composite sub-panel is a sub-component of the composite structure that forms the second composite panel;

wherein the third composite sub-panel is selected from the plurality of composite sub-panels;

wherein the third composite sub-panel is further defined with a center axis;

wherein the fourth composite sub-panel is a sub-component of the composite structure that forms the second composite panel;

wherein the fourth composite sub-panel is selected from the plurality of composite sub-panels;

wherein the fourth composite sub-panel is further defined with a center axis.

14. The kit for the assembly of headwear according to claim 13, wherein the span of the distance between the center axis of the second composite sub-panel and the center axis of the first composite sub-panel equals the span of the distance between the center axis of the second composite sub-panel and the center axis of the third composite sub-panel;

wherein the span of the distance between the center axis of the third composite sub-panel and the center axis of the second composite sub-panel equals the span of the distance between the center axis of the third composite sub-panel and the center axis of the fourth composite sub-panel;

wherein the span of the distance between the center axis of the first composite sub-panel and the fourth edge of the strip equals the span of the distance between the center axis of the fourth composite sub-panel and the second edge of the strip.

15. The kit for the assembly of headwear according to claim 14, wherein the first composite sub-panel comprises a first parabola and a first ring;

wherein the second composite sub-panel comprises a second parabola and a second ring;

wherein the third composite sub-panel comprises a third parabola and a third ring;

wherein the fourth composite sub-panel comprises a fourth parabola and a fourth ring;

wherein the first parabola is a sub-component of the composite sub-panel that forms the first composite sub-panel;

wherein the first parabola is further defined with a center axis which forms the center axis of the first composite sub-panel;

wherein the first parabola projects away from the first edge of the strip such that the center axis of the first parabola is perpendicular to the major axis of the strip;

wherein the first ring is a sub-component of the composite sub-panel that forms the first composite sub-panel;

wherein the first ring is further defined with a center;

wherein the first ring is further defined with a first ring aperture;

wherein the first ring aperture is a circular negative space that is formed through the disk structure of the first ring;

wherein the first ring aperture is coaxially positioned within the first ring;

wherein the second parabola is a sub-component of the composite sub-panel that forms the second composite sub-panel;

wherein the second parabola is further defined with a center axis which forms the center axis of the second composite sub-panel;

wherein the second parabola projects away from the first edge of the strip such that the center axis of the second parabola is perpendicular to the major axis of the strip;

wherein the second ring is a sub-component of the composite sub-panel that forms the second composite sub-panel;

wherein the second ring is further defined with a center;

wherein the second ring is further defined with a second ring aperture;

wherein the second ring aperture is a circular negative space that is formed through the disk structure of the second ring;

wherein the second ring aperture is coaxially positioned within the second ring;

wherein the third parabola is a sub-component of the composite sub-panel that forms the third composite sub-panel;

wherein the third parabola is further defined with a center axis which forms the center axis of the third composite sub-panel;

wherein the third parabola projects away from the first edge of the strip such that the center axis of the third parabola is perpendicular to the major axis of the strip;

wherein the third ring is a sub-component of the composite sub-panel that forms the third composite sub-panel;

wherein the third ring is further defined with a center;

wherein the third ring is further defined with a third ring aperture;

wherein the third ring aperture is a circular negative space that is formed through the disk structure of the third ring;

wherein the third ring aperture is coaxially positioned within the third ring;

wherein the fourth parabola is a sub-component of the composite sub-panel that forms the fourth composite sub-panel;

wherein the fourth parabola is a disk structure that has the shape of a parabola;

wherein the fourth parabola is further defined with a center axis which forms the center axis of the fourth composite sub-panel;

wherein the fourth parabola projects away from the first edge of the strip such that the center axis of the fourth parabola is perpendicular to the major axis of the strip;

wherein the fourth ring is a sub-component of the composite sub-panel that forms the fourth composite sub-panel;

wherein the fourth ring is further defined with a center;

wherein the fourth ring is further defined with a fourth ring aperture;

wherein the fourth ring aperture is a circular negative space that is formed through the disk structure of the fourth ring;

wherein the fourth ring aperture is coaxially positioned within the fourth ring.

16. The kit for the assembly of headwear according to claim 15, wherein the first ring attaches to the first parabola such that the center of the first ring aligns with the center axis of the first parabola;

wherein the second ring attaches to the second parabola such that the center of the second ring aligns with the center axis of the second parabola;

wherein the third ring attaches to the third parabola such that the center of the third ring aligns with the center axis of the third parabola;

wherein the fourth ring attaches to the fourth parabola such that the center of the fourth ring aligns with the center axis of the fourth parabola.

17. The kit for the assembly of headwear according to claim 16, wherein the plurality of tabs comprises a first tab, a second tab, a third tab, and a fourth tab;

wherein the first tab is a rounded rectangular structure;

wherein the second tab is a rounded rectangular structure;

wherein the third tab is a rounded rectangular structure;

wherein the fourth tab is a rounded rectangular structure;

wherein the first slot is sized to receive the first tab of the plurality of tabs;

wherein the second slot is sized to receive the second tab of the plurality of tabs;

wherein the third slot is sized to receive the third tab of the plurality of tabs;

wherein the fourth slot is sized to receive the fourth tab of the plurality of tabs.

18. The kit for the assembly of headwear according to claim 17, wherein the first tab projects away from the third edge of the strip such that the major axis of the first tab is perpendicular to the major axis of the strip;

wherein the second tab projects away from the third edge of the strip such that the major axis of the second tab is perpendicular to the major axis of the strip;

wherein the third tab projects away from the third edge of the strip such that the major axis of the third tab is perpendicular to the major axis of the strip;

wherein the fourth tab projects away from the third edge of the strip such that the major axis of the fourth tab is perpendicular to the major axis of the strip;

wherein the span of the distance between the major axis of the second tab and the major axis of the first tab equals the span of the distance between the major axis of the second tab and the major axis of the third tab;

wherein the span of the distance between the major axis of the third tab and the major axis of the second tab equals the span of the distance between the major axis of the third tab and the major axis of the fourth tab;

wherein the span of the distance between the major axis of the first tab and the fourth edge of the strip equals the span of the distance between the major axis of the fourth tab and the second edge of the strip.

* * * * *